US006302078B1

(12) United States Patent
Singer et al.

(10) Patent No.: US 6,302,078 B1
(45) Date of Patent: Oct. 16, 2001

(54) TWO-STROKE INTERNAL COMBUSTION ENGINE WITH AN ADDITIONAL ENGINE-OIL LUBRICATING SYSTEM

(75) Inventors: Andreas Singer, Fraureuth; Jochen Schoenhaar, Hamburg; Steffen Brauer, Cainsdorf, all of (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 09/380,865

(22) PCT Filed: Jan. 7, 1999

(86) PCT No.: PCT/EP99/00050

§ 371 Date: Nov. 29, 1999

§ 102(e) Date: Nov. 29, 1999

(87) PCT Pub. No.: WO99/35377

PCT Pub. Date: Jul. 15, 1999

(30) Foreign Application Priority Data

Jan. 12, 1998 (DE) ..... 198 00 788

(51) Int. Cl.[7] ..... F01M 11/10

(52) U.S. Cl. ..... 123/196 R; 123/198 D; 220/23.4

(58) Field of Search ..... 220/564, 524, 220/525, 253, 254, DIG. 33, 23.8, 23.2, 23.4, 255, 256, 288; 123/196 R, 198 D, 196 S

(56) References Cited

U.S. PATENT DOCUMENTS

| | | | | |
|---|---|---|---|---|
| 4,535,910 | | 8/1985 | Nagashima . | |
| 6,109,467 | * | 8/2000 | Schliemann et al. | 215/330 |

FOREIGN PATENT DOCUMENTS

| | | | | |
|---|---|---|---|---|
| 2943971A1 | * | 5/1980 | (DE) . | |
| 1164087 | | 9/1969 | (GB) | F16N/29/00 |
| 58071219 | | 4/1983 | (JP) | B60K/15/02 |

* cited by examiner

*Primary Examiner*—Noah P. Kamen
*Assistant Examiner*—Hai Huynh
(74) *Attorney, Agent, or Firm*—McCormick, Paulding & Huber LLP

(57) ABSTRACT

A two-cycle internal combustion engine (10) with additional engine oil lubrication system comprises a fuel tank (11) which can be filled with fuel through a filling opening which can be closed with a fuel tank cap (13), as well as an engine oil tank (12) which can be filled with engine oil through a filling opening which can be closed with an engine oil tank cap (14). A regular checking of the oil-level in the engine oil tank (12) is promoted by the fact that both tanks (11, 12) with their tank caps (13, 14) are so configured that, when filling the fuel tank (11), the operating person's attention is drawn to the engine oil tank (12).

11 Claims, 3 Drawing Sheets

TWO-STROKE INTERNAL COMBUSTION ENGINE WITH AN ADDITIONAL ENGINE-OIL LUBRICATING SYSTEM

TECHNICAL FIELD

This invention relates to the field of the two-cycle internal combustion engines. It concerns a two-cycle internal combustion engine with additional engine oil lubrication system comprising a fuel tank which can be filled with fuel through a filling opening which can be closed with a fuel tank cap, as well as an engine oil tank which can be filled with engine oil through a filling opening which can be closed with an engine oil cap.

PRIOR ART

High speed two-cycle internal combustion engines (Otto engines), such as those which are used for example in hand-operated tools such as chain saws or the like are usually tanked up with a fuel/oil mixture. The oil fraction of the mixture serves to the lubrication of the internal combustion engine.

However, it turned out that, for highly stressed two-cycles engines which are operated with a mixing ratio which is much higher than the formerly usual ratios of 1:25 or 1:50, lubrication problems do appear, since the highly stressed spots are not optimally lubricated, while other spots are further lubricated more than sufficiently. This is why—as for environmental reasons as well—the procedure chosen is that of a separate lubrication for which an additional engine oil lubrication system is provided which obtains the required engine oil for it out of a separate engine oil tank. Since the occuring oil consumption is difficult to control, which is specific to machines with separate lubricaton, it must be seen to that the user checks the content of the engine oil tank sufficiently often and eventually refills it, if the oil-level has dropped. The problem here is that the user of a tool with two-cycle internal combustion engines is generally used to the fact that the lubrication of the machine takes place maintenance-free over the mixture.

DESCRIPTION OF THE INVENTION, AIM, SOLUTION, ADVANTAGES

Therefore, the aim of the invention is to develop a two-cycle internal combustion engine with separate lubrication so that a regular checking of the oil level of the separate lubrication by the user is caused or at least promoted.

The aim of the invention is reached for a two-cycle internal combustion engine of the above mentioned type by the fact that, to assure sufficient engine oil supplies, both tanks are configured with their tank caps so that, when filling the fuel tank, the attention of the operating person is drawn to the engine oil tank. Because the operating person's attention is drawn to the engine oil tank, the operating person is reminded of the existence of the engine oil tank and the separate lubrication. Thus, the probability of a conscious oil-level checking increases. Since this action is connected with the frequent fuel filling operation, the operating person is often enough reminded of the checking of the oil-level.

A first preferred embodiment of the internal combustion engine according to the invention is characterized in that the filling opening of the fuel tank which can be closed with the fuel tank cap and the filling opening of the engine oil tank which can be closed with the engine oil tank cap are placed directly the one besides the other. The result is that the operating person's look when filling the fuel tank simultaneously falls onto the filling opening of the engine oil tank so that the operating person is most probably reminded of the requirements of the separate lubrication.

The operating's person attention can be drawn more strongly to the engine oil tank when, according to a second preferred embodiment, a modification must be made on the engine oil tank cap to open the fuel tank cap. Thus, the operating person is compelled not only to look at the filling opening of the engine oil tank but to directly seize the engine oil tank cap and so to be directly reminded of an oil level checking.

A preferred further development of this embodiment is characterized in that, to open the fuel tank cap, first the engine oil tank cap has to be opened. It is thus ensured that the operating person can have a look into the opened engine oil tank before filling fuel and can easily state if the fuel level in the engine oil tank is sufficient.

Since there is the risk, with this further development, that fuel is filled into the open engine oil tank, it is provided for, according to a further preferred embodiment, that the engine oil tank cap comprises locking means which can be adjusted between a locked position and a released position and, in the locked position, prevent the opening of the fuel tank cap and in the released position allow for the opening of the fuel tank cap. In this case, the engine oil tank cap must not be completely opened, but a moving of the locking means is sufficient. Thus the risk that fuel is unintentionally filled into the engine oil tank is avoided. Moreover, the operating person does no longer get easily an insight into the engine oil tank.

Other embodiments result from the depending claims.

SHORT DESCRIPTION OF THE DRAWINGS

The invention will be described in detail below referring to embodiments shown in the drawings.

Figure 3A:
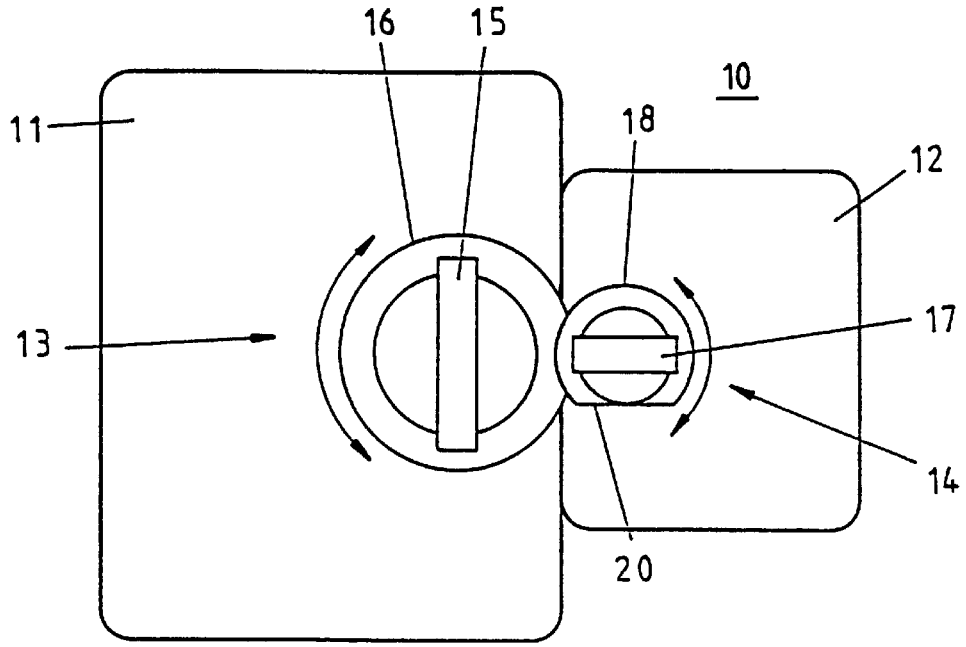

FIGS. 3A, B show a third preferred embodiment of the invention for which the engine oil cap (provided with a recess) must be twisted from a locked position (FIG. 3A) into a released position (FIG. 3B), before the fuel tank cap can be opened.

Figure 4:
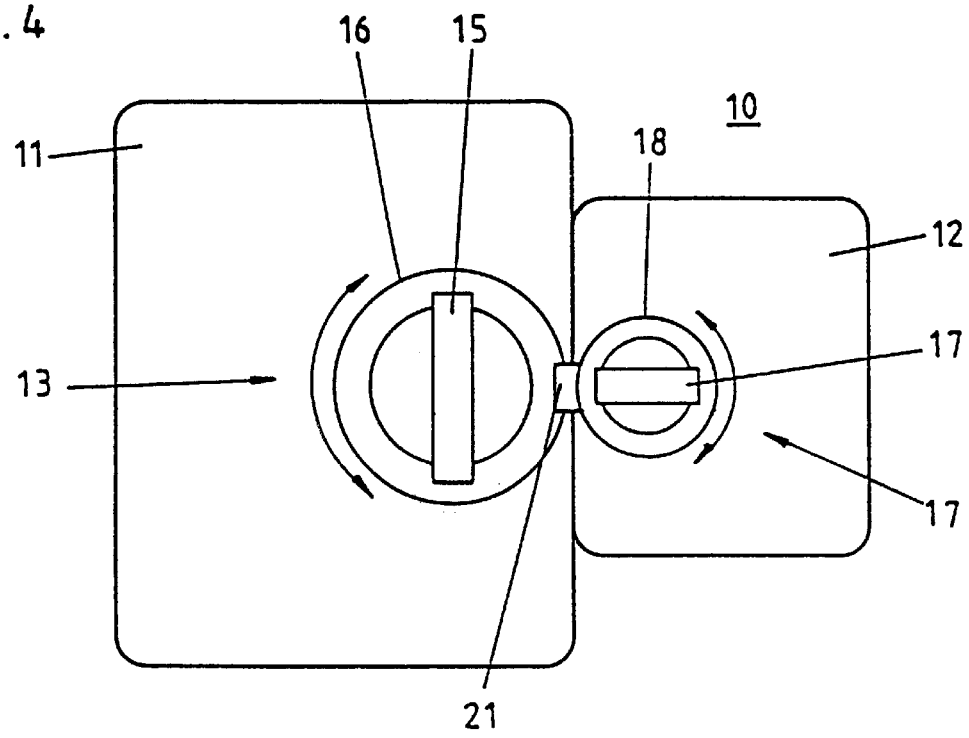

FIG. 4 shows a fourth preferred embodiment of the invention for which the engine oil tank cap (provided with an overlapping catch) must be twisted from a locked position into a released position, before the fuel tank cap can be opened.

Figure 5:
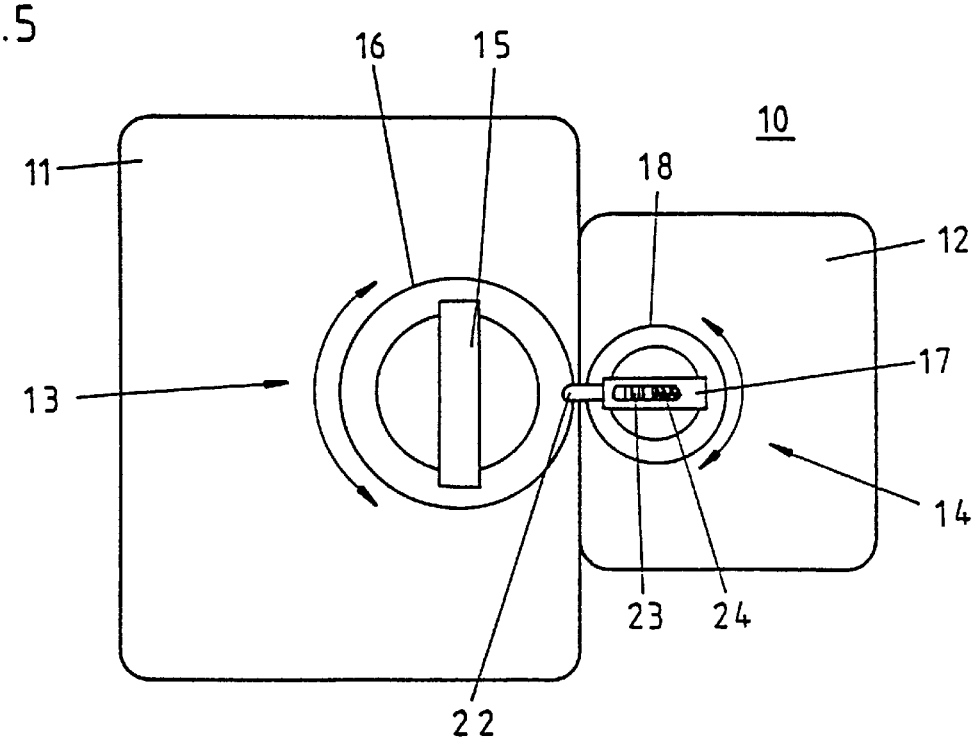

FIG. 5 shows a fifth preferred embodiment of the invention with a withdrawable locking pin, placed in the engine oil tank cap, which has to be withdrawn from a locked position into a released position, before the fuel tank cap can be opened.

BEST WAY FOR CARRYING OUT THE INVENTION

Figure 1:
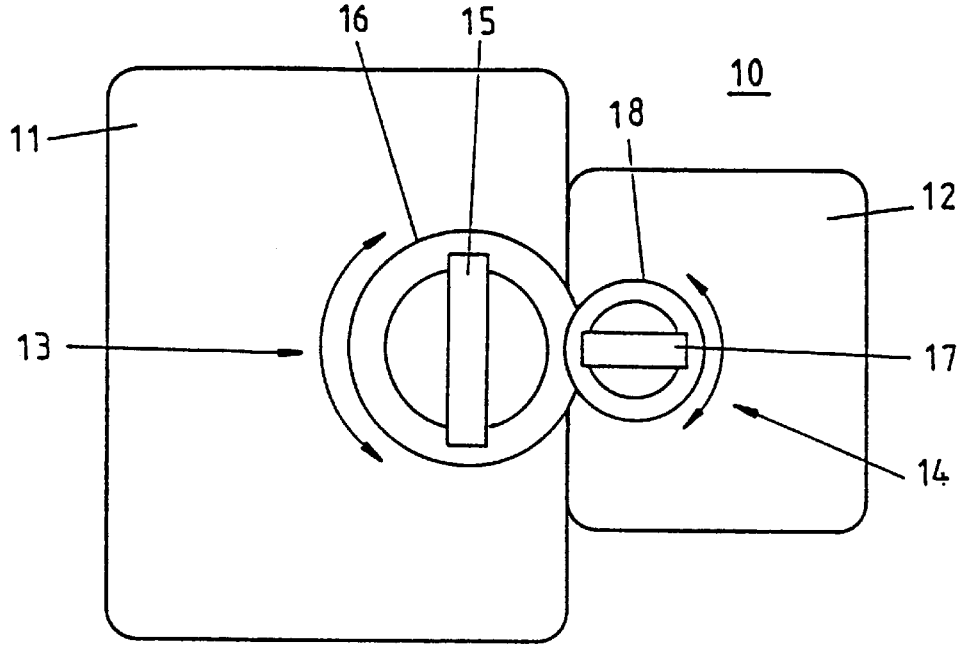
FIG. 1 shows a first preferred embodiment of the invention for which the (overlapping) engine oil tank cap has to be opened (screwed on), before the fuel tank cap can be opened.

FIG. 1 shows a first preferred embodiment of the invention. A fuel tank 11 and an engine oil tank 12, provided for the separate lubrication, are directly placed side by side inside the two-cycle internal combustion engine 10. The fuel tank 11 shows a (not visible) filling opening which can be closed by a fuel tank cap 13. The fuel tank cap 13 is configured for example as a screw-type cap or as a turning cap and can be twisted by means of a grip 15 in direction of the double arrow, the one arrow direction indicating the opening and the other one the closing.

A filling opening (not visible) of the engine oil tank 12, which can be closed by an engine oil tank cap 14, is placed directly besides the filling opening of the fuel tank 11 which can be closed with the fuel tank cap 13. The engine oil tank cap 13 is also configured for example as a screw-type cap or as a turning cap and can be twisted by means of a grip 17 in direction of the double arrow, the one arrow direction indicating the opening and the other one the closing.

The arrangement of the tank caps 13 and 14 very close the one to the other alone has already the effect that the engine oil tank cap 14 also immediately catches the eye of an operating person who will fill the fuel tank 11 with fuel so that the operating person is reminded each time when filling fuel, with no less probability, of the necessity also to check the oil-level in the engine oil tank 12, which is important for the separate lubrication, and to eventually fill it up.

In the arrangement according to FIG. 1, it is provided, to reinforce the connection of both actions beyond the spatial vicinity, that the fuel tank cap 13 can only be opened when the engine oil tank cap 14 has previously been opened. This is reached by the fact that, for closed tanks 11, 12, the engine oil tank cap 14 partially overlaps with its border 18 the fuel tank cap 13 with its border 16. The border 18 of the engine oil tank cap 14 is then placed in a surface plane above the border 16 of the fuel tank cap 13. The engine oil tank cap 14 must first be opened (screwed off) to fill in fuel. The sight in the inside of the engine oil tank 12 is then free and the operating person is automatically informed about the oil-level in the engine oil tank 12. If the engine oil tank cap 13 is removed, the fuel tank cap 13 can then be opened and fuel can be filled in. The closing of the tanks 11, 12 is carried out in reverse order.

Figure 2:
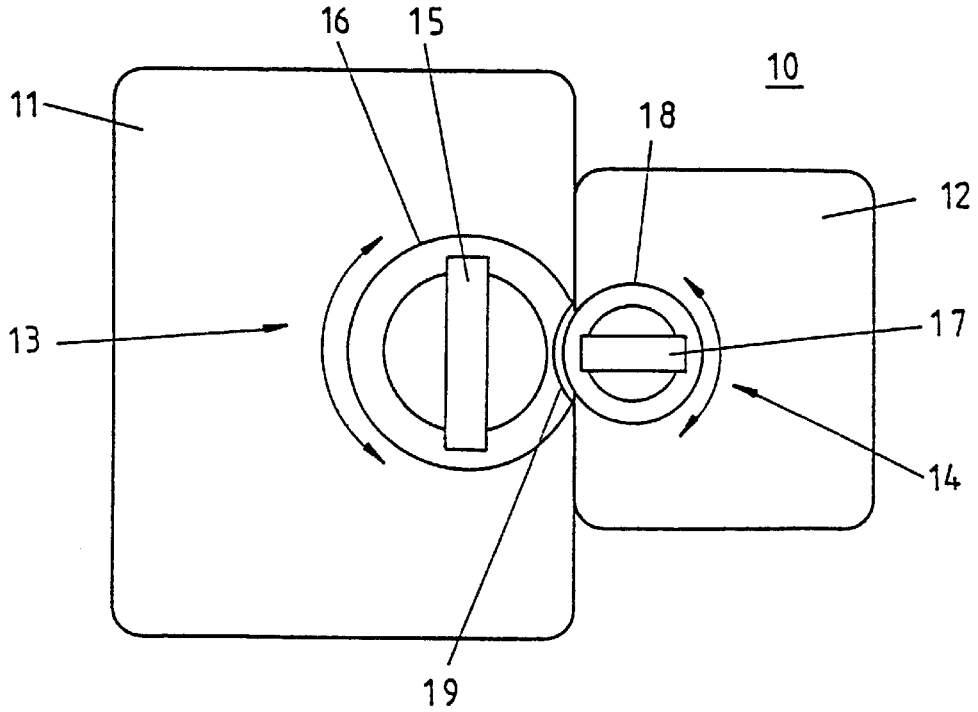
FIG. 2 shows a second preferred embodiment of the invention for which the engine oil tank cap (which engages into a recess in the fuel tank cap) has to be opened (screwed on), before the fuel tank cap can be opened.

The embodiment according to FIG. 2 is recommended if the tank caps 13, 14 (and filling openings) should be placed in the same surface plane (at the same level). In this case, the fuel tank cap 13 is screwed down and shows, at the corresponding place, a recess 19 (in the form of a segment of a circle) into which the engine oil tank cap 14 engages with its border 18. Because of the engagement into the recess 19, the fuel tank cap 13 is blocked up against opening, the engine oil tank cap 14 being closed. Only when the engine oil tank cap 14 is removed, the fuel tank cap 13 can also be turned and thus opened.

In the examples of FIGS. 1 and 2, because of the type of locking, the filling opening of the engine oil tank 12 is open and unprotected, when fuel is being filled into the fuel tank 11. Since both filling openings are very close the one to the other, it can easily happen that fuel is unintentionally filled into the engine oil tank 12. To prevent such a misoperation, according to FIGS. 3A, B, FIG. 4 and FIG. 4, locking mechanisms are proposed for the fuel tank cap 13 which require an actuation of the engine oil tank cap 14 for releasing without the engine oil tank cap 14 having to be opened.

Figure 3B:
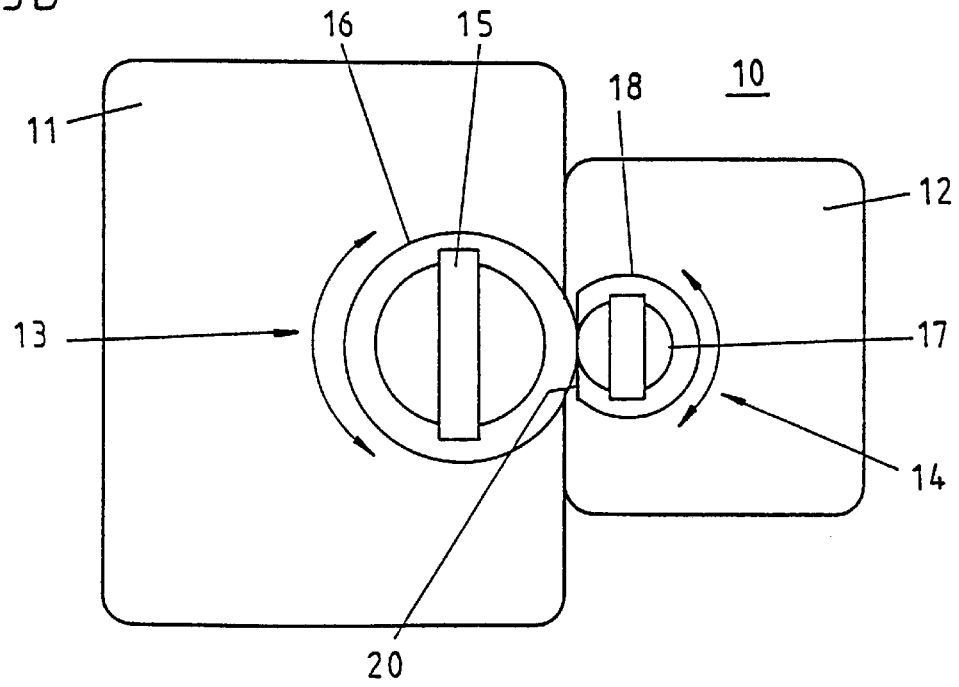

A first preferred embodiment of this type of locking is represented in FIGS. 3A and 3B. The engine oil tank cap 14 partially overlaps—similar to that in FIG. 1—in a locked position (FIG. 3A) with its border 18 the border 16 of the fuel tank cap 13. The border 18 of the engine oil tank cap 14 shows a recess 20 (for example a flattened spot) at a place. If the engine oil tank cap 14 is twisted from the locked position according to FIG. 3A to a released position according to FIG. 3B (in the present case, this occurs through a quarter turn; however, other swing angles <360° are also possible), the recess 20 clears the way for the opening of the fuel tank cap 13.

A second preferred embodiment of this type is represented in FIG. 4. Here, the filling openings of both tanks 11, 12 are so distant from each other that both tank caps 13 and 14 do not overlap. For locking the fuel tank cap 13, a laterally projecting catch 21 is provided on the engine oil tank cap 13 which, in the locking position shown in FIG. 4, covers the border 16 of the fuel tank cap 13 and which is released after a quarter turn (or a rotation about an angle<360°) of the cap 14.

The engine oil tank cap 14 has not to be twisted at all if different locking means according to FIG. 5 are used. In the embodiment of FIG. 5, a locking pin 22, which can be withdrawn against the pressure of a spring 24 by means of an actuating element 23 guided in an oblong hole, is placed in the grip 17 of the engine oil tank cap 14, locking pin which overlaps, in the locking position shown, over the border 16 of the fuel tank cap 13 and which can be relased by being pushed back into the grip 17.

In all represented cases, the operating person is compelled, when filling fuel into the fuel tank 11, to seize and/or to actuate the engine oil tank cap 14 so that the attention by force is also drawn to the engine oil tank 12. The tanks 11 and 12 must not absolutely be adjacent, as represented as an example in the figures, but can also be placed at different spots of the two-cycle internal combustion engine. It is sufficient that the filling openings (filler necks or the like) of both tanks are directly neighboured on each other.

The two-cycle internal combustion engine according to the invention is preferably used for a hand-operated tool, especially a chain saw.

List of reference numerals

10, Two-cycle internal combustion engine
11, Fuel tank
12, Engine oil tank
13, Fuel tank cap
14, Engine oil tank cap
15, Grip (fuel tank cap)
16, Border (fuel tank cap)
17, Grip (engine oil tank cap)
18, Border (engine oil tank cap)
19,20 Recess
21 Catch
22 Locking pin
23 Actuating element
24 Spring

What is claimed is:

1. A two-cycle internal combustion engine (10) with additional engine oil lubrication system comprising a fuel tank (11) which can be filled with fuel through a filing opening which can be closed with a fuel tank cap (13), as well as an engine oil tank (12) which can be filled with engine oil through a filling opening which can be closed with an engine oil cap (14), characterized in that, for assuring sufficient engine oil supplies, both tanks (11, 12) and their tank caps (13, 14) are configured so that, when filling the fuel tank (11) with the fuel tank cap (13) and the oil tank cap (14) initially in closed conditions, the oil tank cap must first be manipulated by the operating person so that the operating person's attention is drawn to the engine oil tank cap (14) of the engine oil tank to remind the operating person of an oil-level checking.

2. A hand-operated tool, especially a chain saw, with a two-cycle internal combustion engine according to claim 1.

3. A two-cycle internal combustion engine (10) with additional engine oil lubrication system comprising a fuel tank (11) which can be filled with fuel through a filling opening which can be closed with a fuel tank cap (13), as well as an engine oil tank (12) which can be filled with engine oil through a filling opening which can be closed with an engine oil cap (14), characterized in that, for assuring sufficient engine oil supplies, both tanks (11, 12) are configured with their tank caps (13, 14) so that, when filling the fuel tank (11), the operating person's attention is drawn to the engine oil tank (12) or to the tank cap (14) of the engine oil tank so that the operating person is reminded of an oil-level checking, said configuration including that the filling opening of the fuel tank (11) which can be closed with the fuel tank cap (13) and the filling opening of the engine oil tank (12) which can be closed with the engine oil tank cap (14) are placed directly side by side.

4. A two-cycle internal combustion engine according to claim 3, characterized in that a modification must be made on the engine oil tank cap (14) to open the fuel tank cap (13).

5. A two-cycle internal combustion engine according to claim 4, characterized in that first the engine oil tank cap (14) must be opened to open the fuel tank cap (13).

6. A two-cycle internal combustion engine according to claim 5, characterized in that the filling openings of the fuel tank (11) and of the engine oil tank (12) are placed side by side so that, the tanks (11, 12) being closed, the engine oil tank cap (14) partially covers with its border (18) the fuel tank cap (13).

7. A two-cycle internal combustion engine according to claim 5, characterized in that the filling openings of the fuel tank (11) and of the engine oil tank (12) are placed side by side so that, the tanks (11, 12) being closed, the engine oil tank cap (14) engages with its border (18) into a recess (19) in the border (16) of the fuel tank cap (13) and locks the fuel tank cap (13) against twisting.

8. A two-cycle internal combustion engine according to claim 4, characterized in that the engine oil tank cap (14) comprises locking means (18, 20; 21; 22, 23, 24) which are adjustable between a locked position and a released position and, in the locked position, prevent the opening of the fuel tank cap (13) and allow, in the released position, for the opening of the fuel tank cap (13).

9. A two-cycle internal combustion engine according to claim 8, characterized in that the filling openings of the fuel tank (11) and of the engine oil tank (12) are placed side by side so that, the tanks (11, 12) being closed, the engine oil tank cap (14) partially covers with its border (18) the fuel tank cap (13) and that the engine oil tank cap (14) shows a recess (20) in its border (18) so that, when twisting the engine oil tank cap (14) about an angle <360°, the overlapping of the two caps (13, 14) is completeley suppressed.

10. A two-cycle internal combustion engine according to claim 8, characterized in that the filling openings of the fuel tank (11) and of the engine oil tank (12) are placed side by side so that, the tanks (11, 12) being closed, the engine oil tank cap (14) overlaps, with a laterally projecting catch (21), over the border (16) of the fuel tank cap (13) so that, when twisting the engine oil tank cap (14) about an angle <360°, the overlapping of the catch (21) is completely suppressed.

11. A two-cycle internal combustion engine according to claim 8, characterized in that the filling openings of the fuel tank (11) and of the engine oil tank (12) are placed side by side so that, the tanks (11, 12) being closed, the engine oil tank cap (14) overlaps, with a laterally projecting locking pin (22), radially movable, over the border (16) of the fuel tank cap (13) so that, when withdrawing the locking pin (22), the overlapping of the locking pin 822) is completely suppressed.

* * * * *